US006547337B2

(12) United States Patent
Welch, Jr.

(10) Patent No.: US 6,547,337 B2
(45) Date of Patent: Apr. 15, 2003

(54) TRENCHER WITH FOLDABLE ROCK SAW WHEEL

(75) Inventor: Johnnie C. Welch, Jr., Arlington, TX (US)

(73) Assignee: Tesmec USA, Inc., Alvarado, TX (US)

( * ) Notice: Subject to any disclaimer, the term of this patent is extended or adjusted under 35 U.S.C. 154(b) by 0 days.

(21) Appl. No.: 09/942,141

(22) Filed: Aug. 29, 2001

(65) Prior Publication Data

US 2003/0042785 A1 Mar. 6, 2003

(51) Int. Cl.[7] ..... E01C 23/09; B27B 33/02; B28D 1/12

(52) U.S. Cl. ..... 299/39.3; 125/15; 83/838; 37/189; 37/465

(58) Field of Search ..... 299/39.3; 125/15; 83/676, 835, 838; 30/347; 37/465, 91, 189, 462; 451/526, 527, 548

(56) References Cited

U.S. PATENT DOCUMENTS 195,263 A 9/1877 Deforce
1,194,460 A 8/1916 Yocum
1,199,366 A 9/1916 French
1,448,579 A 3/1923 Tideman
2,622,351 A 12/1952 Walters
2,859,544 A 11/1958 Evans
3,603,010 A 9/1971 Polinek
4,716,665 A 1/1988 Johnson et al.
4,887,372 A 12/1989 Block
5,027,684 A * 7/1991 Neukam ..... 83/481
5,575,538 A * 11/1996 Gilbert et al. ..... 299/39.3

* cited by examiner

*Primary Examiner*—David Bagnell
*Assistant Examiner*—Sunil Singh
(74) *Attorney, Agent, or Firm*—Marc A. Hubbard; Munsch Hardt Kopf & Harr, P.C.

(57) ABSTRACT

A trencher with a rock saw wheel has a foldable section that may be pivoted to one side during transport of the trencher on a truck or trailer, in order to decrease the overall height of the trencher during transport, or can be removed to reduce transport weight.

11 Claims, 3 Drawing Sheets

TRENCHER WITH FOLDABLE ROCK SAW WHEEL

TECHNICAL FIELD OF THE INVENTION

The present invention relates generally to the field of trenchers, and more particularly to a trencher with a foldable rock saw wheel.

BACKGROUND OF THE INVENTION

There are basically three types of trenching machines; bucket wheel, chain type, and disk (or saw). Bucket wheels are basically for softer materials, and the chain type and disk type are better suited for hard rock trenching, but all can be used for soft material trenching. A typical chain or saw trencher has a digging boom or frame that is connected to a tractor. Chain type trenchers are capable of much wider and deeper trenching than the disk type. However, they have two problems. First, the chain will wear much quicker. Second, a wider trench must be cut in order to provide clearance for the chain. The disk or saw type trencher typically cuts shallower and narrower than an equivalent size chain type trencher. It has a rigid wheel, typically in the form of a round, solid metal disk, and cutters attached around the wheel's outer circumference or periphery.

As a disk wears much better than a chain, the total cost of using a disk or saw for trenching can be significantly less. However, digging deeper trenches requires use of a larger diameter saw. Because a trencher with a large saw must be transported to a digging site on the back of a trailer, with the saw mounted on the boom, height restrictions on public roadways limit the size or diameter of a rock saw on a trencher. Many trenchers are designed to allow use of both saw and chain attachments. Deeper trenches are preferred for burying fiber optic and other comparatively fragile cables. Doing so reduces the risk of the cable being accidentally cut during subsequent construction.

SUMMARY OF THE INVENTION

The present invention concerns an improved saw for a trenching machine. According to the invention, a trenching machine includes a rock saw wheel with at least one section that can be folded and/or removed. This separate section permits transporting a trenching machine with a rock saw wheel that would otherwise be too large for transport or to obtain a permit for transport on public roadways without completely disassembling the wheel. Thus, deeper trenches can be dug using a saw or disk trencher with a lower total cost of operation.

One example of a trenching machine employing one or more teachings of the invention has a rock saw wheel with at least one section or piece separate from a main portion of the wheel. The main portion of the wheel is mounted to the trencher. At least one of the one or more separate sections is attached to the main portion during normal operation by one or more connecting plates that span at least a portion of a seam where the foldable section abuts the main portion of the wheel. One or more removable fasteners—bolts, for example—connect the plate(s) to the main portion and to a section. The plates thereby provide rigidity to the wheel for operation. The fasteners are removed to allow the separate section to be folded to a side or removed altogether, which reduces the diameter of the rock saw in one direction to a size that allows for transport over public roadways.

It is preferred that one connecting plate for at least one separate section be attached at one end to the main portion so that it pivots, such as by use of a hinge or similar mechanism. Thus, the separate section remains connected to the main portion of the wheel, but folded or pivoted to the side during transport of the trenching machine. With a pivoting connection, the separate section can be swung into place and assembled for operation with fewer steps and without, in the case of very large wheels, the need for additional lifting equipment. It also avoids having to separately stow the section on the trailer. Furthermore, it is preferred that the pivoting connection be of a type that permits disconnecting the separate section for removal should a reduction in transport weight as well as a height reduction be needed.

A preferred embodiment of the invention is further described below with reference to the accompanying drawings.

BRIEF DESCRIPTION OF THE DRAWINGS

In the accompanying drawings.

DETAILED DESCRIPTION OF THE DRAWINGS

Figure 1:
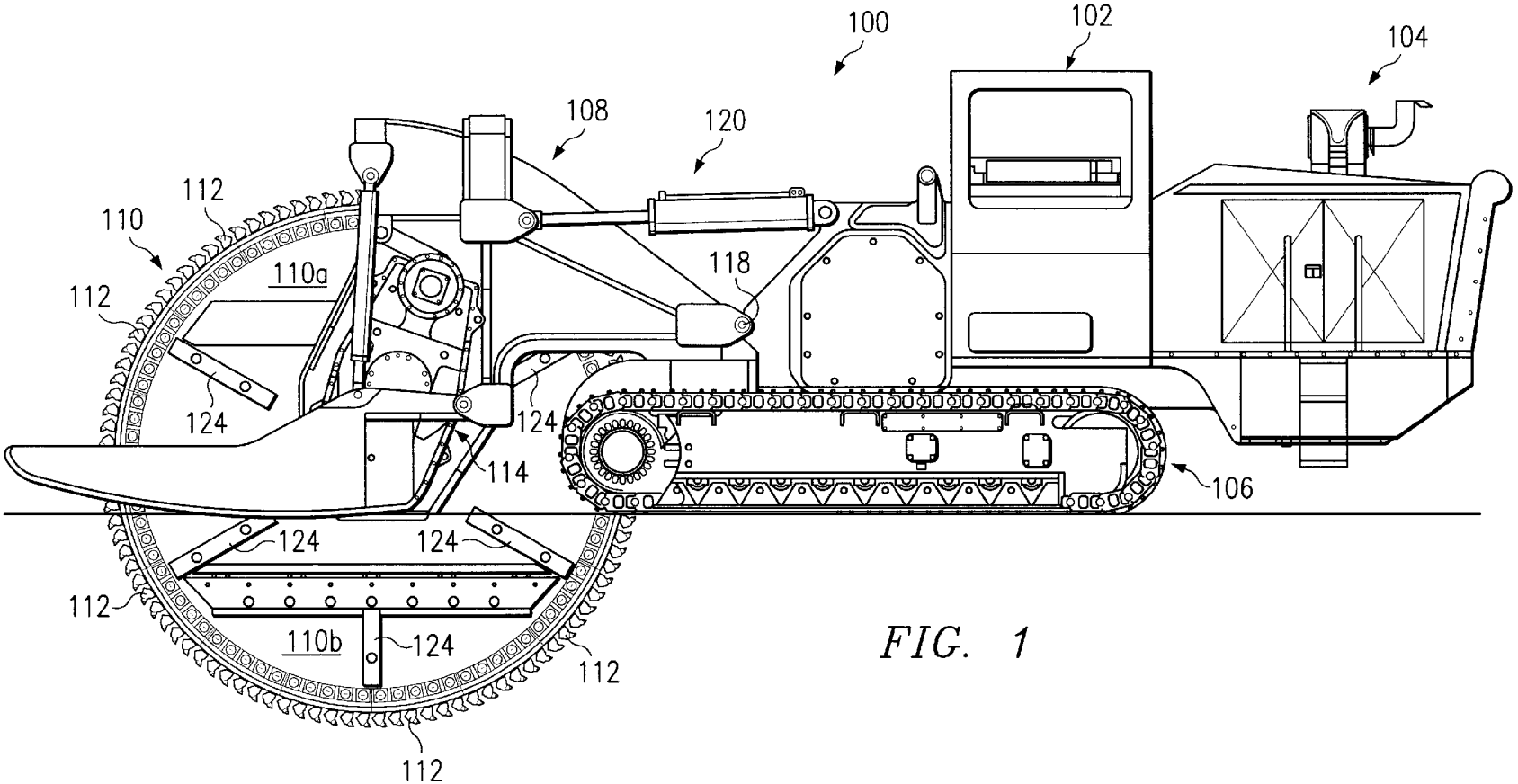
FIG. 1 is a schematic diagram of a trenching machine or trencher with a foldable rock saw.

Like numerals reference like and corresponding parts throughout the drawings. Referring to FIG. 1, trenching machine or trencher 100 is an example of a trenching machine. It is intended only to be representative of a trenching machine with which the teachings of the invention may be used. The trencher includes a cab 102, in which an operator sits, at least one motor 104, a pair of crawlers 106 for locomotion, and a structure for supporting and lowering and raising a rock saw such as a pivoting boom 108, which is shown in FIG. 1. The illustrated rock saw is an example of a type of saw that has a disk-shaped wheel, generally designated 110. Although shown as a solid disk, the wheel need not be entirely solid, but could have portions cut out if weight reduction was desired. The wheel could be made of an assembly of structure members as a wheel, though a disk is easier to make into a wheel suitable for digging trenches. It is stronger and less prone to failure.

Wheel 110 has at least two separate sections. In the illustrated example, it has a main or central portion or section 110*a* and at least one secondary section 110*b*. Each junction or split between the separate sections of the wheel may occur anywhere that, when one portion is removed or turned to a side, the diameter of the wheel is reduced, thereby resulting in its overall height being able to be lowered for transport when it is attached to the trencher. However, it is preferable that the junction between the pieces not intersect the area of the wheel at which it is coupled to a rotary power source, as doing so introduces additional stresses at the point of coupling that are undesirable. Furthermore, for structural reasons, it is also preferrable for the junction to be located as far as possible from the center of the wheel while still allowing for the desired lowering in height. A plurality of cutting tools 112 is attached around the outer circumference or perimeter of the wheel. These tools are, preferably, suitable for cutting rock and other hard geological formations. Many examples of such tools are known. A transmission, of which gear train 114 is a part, couples rotary power from the engine to a rotary output by hydraulic or mechanical means. Hub 116 of wheel 110 is coupled to this rotary output. Hub 116 of the wheel preferably includes a reinforcing disk 122. The hub and disk are attached to the main section of the wheel by bolts 123, but could be attached by other means, including welds. Boom 108 pivots about axis 118 in order to raise it for transport and lower it for trenching. Hydraulic piston and cylinder 120 is an example of one means for raising and lowering the boom. Any means suitable for raising and lowering the boom and rock saw may be employed in place of hydraulic piston and cylinder 120. The boom is shown in a lowered position. Although a boom is more advantageous, other means for lowering and raising the wheel may be employed, such as a gantry and slide.

Figure 2:
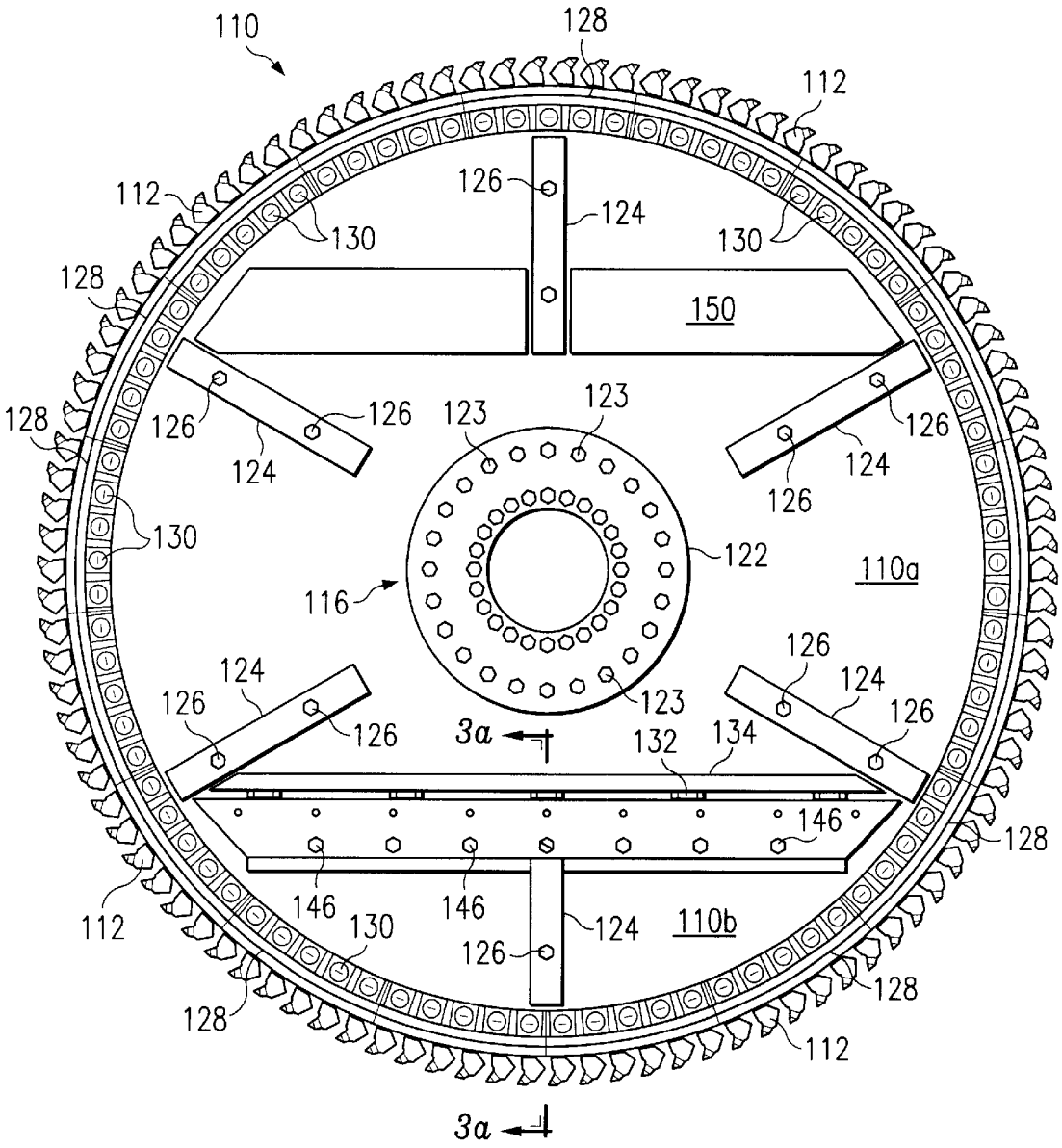
FIG. 2 is a side view of the foldable rock saw wheel shown in FIG. 1.

Referring to FIGS. 1, 2, and 3*a*, 3*b*, 3*c* and 3*d*, bars 124 do not allow material build-up between the wheel and the ditch while cutting. A second set of bars 124, which cannot be seen in FIGS. 1 or 2, are attached to the other side of the wheel, opposite the visible ones. These cleaning bars are arrayed symmetrically about the center of the wheel and extend along the radii of the wheel. They are preferably attached by bolts 126, secured by nuts, to the wheel, but are not required to be. Cutting tools 112 are preferably held by a plurality of removable tool holders 128, each of which is attached by a suitable fastener, such as one or more bolts 130, secured with nuts, to the outer diameter or circumference of the wheel. In the illustrated example, each tool holder carries more than one cutting tool, though each could be made to hold only one if desired.

At least one, and preferably two, connecting plates, 136 and 140 join sections 110*a* and 110*b* for operation of the rock saw. The connecting plate(s) span the junction of the sections on opposite sides of the wheel. Releasable fasteners, such as bolts or screws 146, attach the connecting plates to the wheel. Each bolt preferably passes through both connecting plate(s) and the main portion or the foldable section. The bolts on at least one side of the junction of the main portion and foldable section are loosened and removed to allow the foldable section to be folded to one side.

Figure 3A:
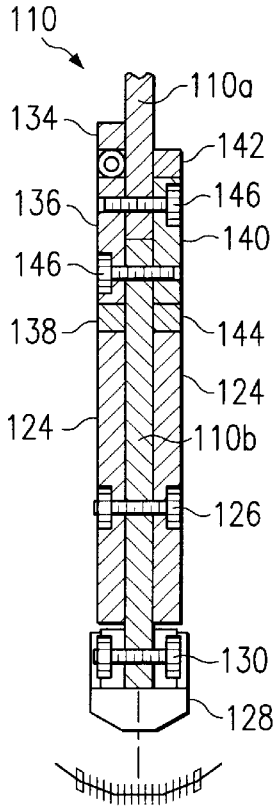
FIG. 3*a* is a sectional view of the rock saw wheel of FIG. 2, taken along section line 3*a*—3*a*, with a separable section of the wheel shown connected to a main portion of the wheel and in a normal operating configuration.
Figure 3B:
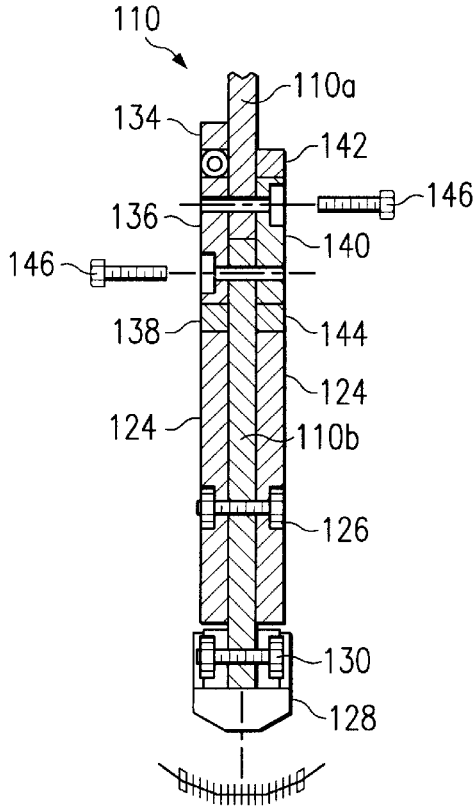
FIG 3*b* is a sectional view of the rock saw wheel of FIG. 2, taken along section line 3*a*—3*a*, with certain bolts removed as a first step in folding the separable section.
Figure 3C:
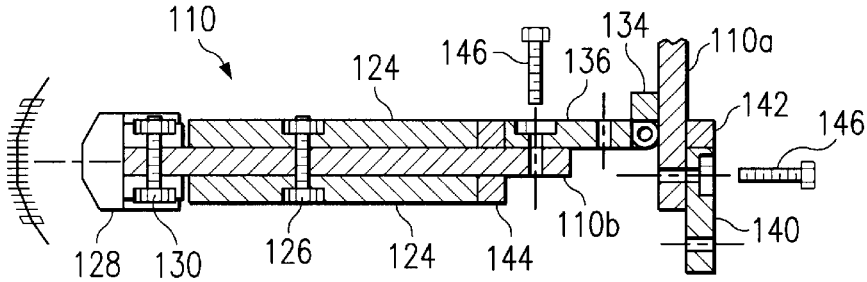
FIG. 3*c* is a sectional view of the rock saw wheel of FIG. 2, taken along section line 3*a*—3*a*, with the separble section folded but still connected.
Figure 3D:
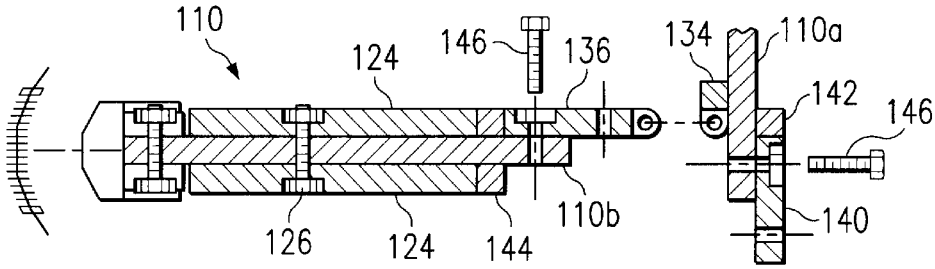
FIG. 3*d* is a sectional view of the rock saw wheel of FIG. 2, taken along section line 3*a*—3*a*, with the separable section separated following removal of hinge pins.

It is preferred that main section 110*a* be attached to secondary section 110*b* in a manner that allows the secondary section to be pivoted to one side for transport, yet remain attached to the main section. One or more hinges to couple the two sections for pivoting. Having the secondary section remain attached allows it to be relatively easily swung to one side for transport, and then back again for assembly. In a preferred embodiment that is illustrated, multiple hinges 132 are used, as it is easier to assemble. However, a single hinge can be used in its place, and no form of hinge is required. One side of hinge 132 is, in the example, attached to bar 134, which in turn is welded to main portion 110*a* of the wheel, the other edge of hinge 132 is welded directly to main portion 110*a* of the wheel. The other side of hinge 132 is attached to connecting plate 136. Connecting plate 136 spans the junction of the two sections, 110*a* and 110*b*, of the wheel 110 when the wheel is operational. Plate 136 is attached to secondary section 110*b*, preferably by direct welding though it could be attached in other ways. Bar 138 is attached, preferably by a weld, to main section 110B for strength and erosion control. Connecting plate 140 is placed on the opposite of the junction. It is attached to main section 110*a* of the wheel, preferably by direct welding to section 110*a*. Bar 142, which is attached to the wheel, preferably by a weld, balances bar 134, which is on the opposite side of the wheel, and protects plate 140 from erosion. Bar 144, which is attached to the wheel, preferably by a weld, balances bar 138 which is on the opposite side of the wheel, and protects plate 140 from erosion and prevents debris from entering the joint. Thus, when threaded bolts 146 are removed, as shown in FIG. 3*b*, and the tool holders 128 (see FIG. 2) spanning the joint are removed, the secondary section 110*b* of the wheel can be swung to one side, as shown in FIG. 3*c*. Pins 148 can also be removed from the hinge 132, allowing sections 110*a* and 110*b* to be separated should a weight reduction as well as a height reduction be needed, as shown in FIG. 3*d*. Plates 150 are located on both sides of the wheel, opposite the shaft for balance during rotation, as shown in FIG. 3.

If additional height clearance is required for transport, wheel 110 could include an additional secondary section, located opposite of the hub of the wheel from secondary section 110*b*. Generally, it is preferably not to have the seam or junction between sections of the wheel run through the wheel's hub in order to avoid having to detach a portion of the wheel from the hub.

While the invention has been particularly shown and described by the foregoing detailed description, it will be understood by those skilled in the art that various other changes in form and detail may be made without departing from the spirit and scope of the invention.

What is claimed is:

1. A rock saw wheel for a trencher, the rock saw wheel comprising a wheel for supporting a plurality of cutting elements around its periphery; the wheel having a first section for attaching to a rotary power source and at least one second section that, when placed in a common plane with the first section, establishes a round wheel and, if one of the at least one second section is removed, reduces the wheel's diameter along at least one direction; the one of the at least one second section being joined to the first section by at least one connecting plate attached to the first section and/or the one of the at least one second section by at least one releasable fastener.

2. The rock saw wheel of claim 1, wherein the one of the at least one second section is pivotally connected to the first section, whereby the one of the at least one second section may be pivoted toward one side of the wheel while remaining connected to the first section.

3. The rock saw wheel of claim 1, wherein the connecting plate is attached to either the first section or the one second section by at least one hinge.

4. The rock saw wheel of claim 1 further comprising another connecting plate for joining the one of the at least one second section to the first section on a side of the wheel opposite the at least one connecting plate.

5. The rock saw of wheel of claim 1 wherein the one of the at least one second section is removable for reducing transport weight as well as height.

6. A trencher with a foldable rock saw, said trencher comprising:

a frame;

a motor; and a transmission coupling the motor to a rotationally mounted rock saw wheel;

wherein, the rock saw wheel comprises a wheel, around which is disposed a plurality of cutting elements; the wheel having a first section and at least one second section that, if removed, reduces the wheel's diameter along at least one direction; one of the at least one second section being joined to the first section by at least one connecting plate attached to the first section and/or the one of the at least one second section by at least one releasable fastener.

7. The rock saw wheel of claim 6, wherein the one of the at least one second section is pivotally connected to the first section.

8. The rock saw wheel of claim 6, wherein the connecting plate is connected to at least one of the first section and the one of the at least one second section by at least one hinge.

9. The rock saw of wheel of claim 6 further comprising another connecting plate joining the one of at least one second section to the first section on a side of the wheel opposite the at least one connecting plate.

10. A method for transporting over roadway a trencher, the trencher having rotationally mounted to it a foldable rock saw, the rock saw including a wheel, around which is disposed a plurality of cutting elements; the wheel having a first section and at least one second section that, if removed, reduces the wheel's diameter along at least one direction; one of the at least one second section being pivotally connected to the first section so that the one of the at least one second section may be pivoted toward one side of the wheel while remaining connected to the first section, the method comprising:

pivoting the one of the at lest one second section to one side of the wheel in order to reduce the trencher's overall height;

transporting the trencher on a road vehicle to a site;

pivoting the one of the at least one second section so that it is in a common plane with the first section at the site; and joining the first section and the one of the at least one second section by at least one connecting plate in order to prevent pivoting during trenching operation.

11. The method of claim 10 further comprising unfastening the one of the at least one second section from the first section prior to transporting the trencher and refastening the one of the at least one second section to the first section after transporting.

* * * * *